United States Patent [19]

Guttmann et al.

[11] 4,388,082

[45] Jun. 14, 1983

[54] DEVICE FOR OBTAINING LARGE AMOUNTS OF COMBUSTIBLE GAS FROM CARBONACEOUS MATERIALS

[75] Inventors: Friedrich W. Guttmann, Bergisch Gladbach; Horst Weigel, Cologne, both of Fed. Rep. of Germany

[73] Assignee: Klöckner-Humboldt-Deutz AG, Fed. Rep. of Germany

[21] Appl. No.: 317,748

[22] Filed: Nov. 3, 1981

[51] Int. Cl.[3] ..... C10B 53/02

[52] U.S. Cl. ..... 48/76; 48/77; 48/111; 48/209

[58] Field of Search ..... 48/111, 209, 76, 77, 48/73, 63, 64; 110/229, 269, 278

[56] References Cited

U.S. PATENT DOCUMENTS

| | | | |
|---|---|---|---|
| 473,963 | 5/1892 | Roney | 110/278 |
| 609,705 | 8/1898 | Sanderson | 48/76 |
| 855,845 | 6/1876 | De Galocsy et al. | 48/76 |
| 1,341,517 | 5/1980 | Perry | 48/63 |

FOREIGN PATENT DOCUMENTS

| | | | |
|---|---|---|---|
| 874673 | 5/1942 | France | 48/111 |
| 40295 | 3/1937 | Netherlands | 48/111 |
| 66861 | 11/1926 | Sweden | 48/76 |
| 17375 | 2/1909 | United Kingdom | 110/269 |

OTHER PUBLICATIONS

Brockhaus der Naturwissenschaften und Technik, 3, Auflage, Wiesbaden 1953, p. 246.

*Primary Examiner*—William F. Smith

*Attorney, Agent, or Firm*—Hill, Van Santen, Steadman, Chiara & Simpson

[57] ABSTRACT

A device for obtaining large amounts of combustible gas from carbonaceous materials, such as wood chunks and other wood waste material, by gasification of such wood material resulting in partial combustion thereof has a gas-tight combustion chamber having a rectangular cross section and having a material charging device and an ash discharge device respectively disposed at upper and lower portions thereof. The chamber has a number of gas removal lines connected thereto and has a number of air nozzles uniformly disposed in longitudinal walls of the chamber in at least one plane as well as a number of uniformly spaced air supply lances which extend to a central interior portion of the chamber for supplying air for aiding combustion of the material therein. The device may be subdivided into a number of individual chambers by partitions disposed in the chamber.

4 Claims, 2 Drawing Figures

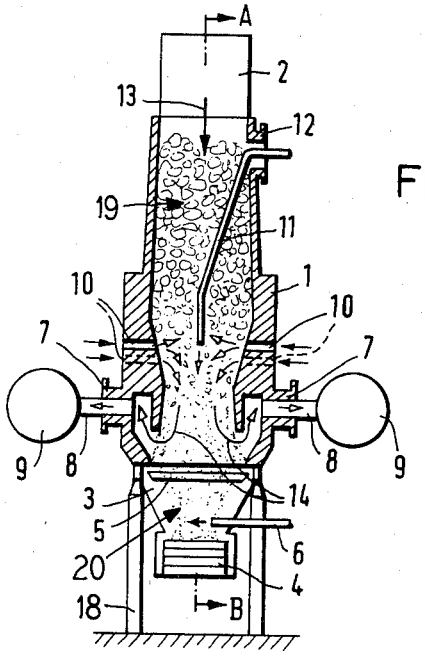
FIG.1
FIG.2
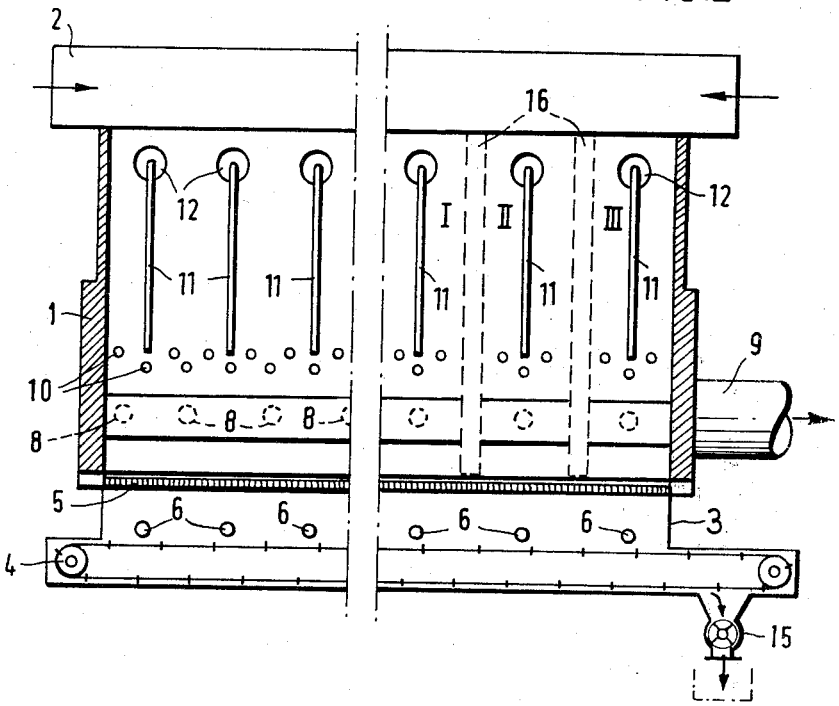

DEVICE FOR OBTAINING LARGE AMOUNTS OF COMBUSTIBLE GAS FROM CARBONACEOUS MATERIALS

BACKGROUND OF THE INVENTION

The present invention relates to devices for gasification of carbonaceous materials, and in particular to devices for obtaining significant amounts of combustible gas from the combustion of such materials, in particular wood chunks and wood waste.

Devices for the gasification of wood material are known which in general consist of a gas-tight combustion chamber which is connected to a means for charging the chamber with material to be burned and a means for removing the ash which is formed as a result of the combustion. Such devices generally have a number of nozzles for supplying combustion air to the chamber as well as discharge lines for removing the combustible gases.

Such conventional wood gas generators have a circular cross section and the air which is necessary for the gasification is supplied through a number of nozzles which are disposed about the circumference of the circle. A partial combustion of the wood is thus obtained, whereby oxygen in the combustion air combines with the carbon in the cellulose of the wood. The gas mixture resulting from such combustion generally consists of combustible components such as carbon monoxide (CO), hydrogen ($H_2$), nitrogen ($N_2$), hydrocarbons such as methane ($CH_4$), and non-combustible components such as carbon dioxide ($CO_2$) and water vapor ($H_2$). If the gas mixture is mixed with the primary air supply which is used as the combustion gas a partial decomposition of the $CO_2$ and $H_2O$ respectively into CO and $H_2$ occurs if sufficient heat is provided, whereby the liberated oxygen bonds to the remaining carbon of the wood material. By supplying secondary air through the ash, unburned material in the ash can be further converted into gas, to the extent that the material temperature is sufficient in the zone where the secondary air interacts with the ash.

Because of the circular cross section of such conventional wood gas generators, such generators have a relatively small material handling capacity because the penetration depth of the gasification air is limited. If the circular cross section is enlarged, a portion of the cross-sectional surfaces are either minimally or not at all exposed to the primary air supply and the material located in such cross-sectional areas is poorly or not at all gasified.

SUMMARY OF THE INVENTION

It is an object of the present invention to provide a device for obtaining large amounts of combustible gas from carbonaceous materials, such as cellulose-containing materials, which achieves a significant increase in the material handling capabilities together with improved efficiency in the degree of gasification of the cellulose-containing material.

The above object is inventively achieved in a wood gasification device which has a rectangular combustion chamber with air nozzles which are uniformly disposed in longitudinal walls of the chamber in at least one plane through which primary air is supplied to the material, and which is further provided with a number of air supply lances which extend into and terminate at a central area of the chamber for further supplying primary combustion air to the material. In contrast to conventional circular devices, which as explained above cannot be enlarged beyond a certain optimum dimension, the rectangular chamber in accordance with the principles of the present invention permits a substantially unlimited increase in the material handling capabilities, or throughput, of the device while retaining a uniformly good air penetration even when the device is enlarged. Enlargement of the device proceeds in one direction, namely in the longitudinal direction of the chamber.

In a further embodiment of the invention the combustion chamber may be subdivided into individual chambers by means of partitions disposed in the chamber. This permits the change in the throughput yield to be obtained in a relatively simple manner by means of simply adding or subtracting chambers which are to be used.

BRIEF DESCRIPTION OF THE DRAWINGS

FIG. 1 is a sectional view of a gasification device having a rectangular combustion chamber constructed in accordance with the principles of the present invention.

FIG. 2 is a sectional view taken along line A-B of FIG. 1.

DESCRIPTION OF THE PREFERRED EMBODIMENTS

A device for the gasification of cellulose-containing material constructed in accordance with the principles of the present invention is shown in two different sectional views in FIGS. 1 and 2. The device consists of a combustion chamber 1 which is sealed gas-tight from the atmosphere and which is mounted on a suitable supporting structure 18. The combustion chamber 1 is connected to a charging means 2 at an upper portion thereof for supplying cellulose-containing material 19 to the combustion chamber 1 in the direction of the arrow 13. The cellulose-containing material 19 may be, for example, chunks of wood or other types of wood waste material. The combustion chamber 1 is substantially rectangular in cross section.

The bottom of the combustion chamber 1 is connected to a funnel-like discharge means 3 which in turn communicates with a conveyor means 4 for removal of the ash 20 which results from the combustion of the cellulose-containing material 19. The conveyor means 4 may, for example, be an endless scraper belt or a chain conveyor. An ash grate 5, which forms the floor of the combustion chamber 1, is disposed between the conveyor means 4 and the chamber 1. The ash grate 5 may be an oscillating grate and may be drivingly connected with the conveyor means 4 via suitable dogs so as to be driven by the conveyor means 4. The conveyor means 4 is driven by a suitable drive means not shown. A plurality of nozzles 6 for supplying secondary gasification air to the ash 20 are disposed between the conveyor means 4 and the ash grate 5 in the walls of the discharge means 3.

A plurality of gas vent muffs 7 are uniformly disposed along both longitudinal walls of the chamber 1 above the ash grate 5, each muff 7 receiving a conduit 8 which are connected to a common gas collecting line 9.

A plurality of uniformly disposed air nozzles 10 are provided along the two longitudinal walls of the combustion chamber 1 for supplying primary gasification air to the interior of the chamber 1. Additional combustion air is supplied by a plurality of uniformly spaced air supply lances 11 which are introduced through a muff 12 at an upper portion of the chamber 1 and extend to a central area of the chamber 1 and terminate at a level approximately equal with the air nozzles 10, which is the region of the combustion chamber 1 in which combustion primarily takes place. As can be best seen in FIG. 2, the air nozzles 10 are disposed in the walls of the chamber 1 in two rows, whereas the air supply lances 11 are introduced into the central volume of the chamber 1 with equal spacing.

Because of the rectangular shape of the combustion chamber 1, the chamber can be designed for significantly increased throughput yields than conventional wood gasifiers while retaining a constantly high gasification efficiency. Charging of the chamber 1 with carbonaceous materials, such as wood chunks, is undertaken continuously or discontinuously from the top of the chamber 1 in the direction of the arrow 13 in such a manner that no air is introduced with the material 19. The materials slowly move from the upper region of the chamber 1 to a bottom region thereof by gravimetric flow so as to arrive in the gasification zone which is the region of the chamber 1 at which the nozzles 10 and lances 11 introduce primary air into the chamber 1.

After initial ignition of the material 19, aided by air supplied through the nozzles 10 and the lances 11, a partial combustion of the carbonaceous material 19 occurs. The gas mixture arising as a result thereof is conducted toward the bottom of the chamber 1 in a current flow together with the reacting materials and is withdrawn in the direction of the arrows 14 via the conduits 8 and the gas collecting lines 9. Gasification residues such as ash fall through the grate 5 into the funnel discharge means 3 from where the residues are continuously withdrawn with the conveyor means 4 situated therebeneath, for eventual removal by a cellular wheel sluice 15.

For further gasification of unburned materials contained in the ash 20, secondary air is introduced via the nozzles 6 below the grate 5, which results in a reburning and regasification of those previously unburned materials above the grate 5.

As further shown in the right portion of the device in FIG. 2, the chamber 1 can be subdivided into a plurality of individual chambers, such as chambers I, II and III, by means of a plurality of partitions 16. Such a subdivision of the chamber 1 into individual chambers makes the addition and subtraction of individual chambers possible as needed so that a good matching to the desired throughput yield and combustible gas production can be achieved. Although only three chambers are shown in FIG. 2, it will be understood that the chamber 1 can be subdivided into as many chambers as is desired, as well as being elongated to any reasonable length needed. All of the individual chambers in the combustion chamber 1 can be continuously charged with the carbonaceous material 19 by means of a single charging device 2, while the supply of gasification air into the individual chambers can be optimally set or independently regulated for each individual chamber. The device disclosed herein results in a particularly high throughput yield with a compact structure which provides means for operating the device over a wide range of operating characteristics to accommodate the nature of the particular amount and type of cellulose-containing material which is to be gasified.

Although modifications and changes may be suggested by those skilled in the art it is the intention of the inventors to embody within the patent warranted hereon all changes and modifications as reasonably and properly come within the scope of their contribution to the art.

We claim as our invention:

1. A device for gasification of carbonaceous materials and for recovery of combustible gases therefrom comprising:

a combustion chanber having a rectangular cross-section and having an upper region, a central region wherein said combustion takes place, and a lower region;

a material charging means connected to said upper region of said combustion chamber for charging said combustion chamber with said carbonaceous material to be gasified;

a plurality of partitions in said combustion chamber disposed parallel to the flow of said carbonaceous material therethrough dividing said combustion chamber into a plurality of sub-chambers;

a plurality of air nozzles disposed in longitudinal walls of said combustion chamber for supplying primary combustion air to said central region of said combustion chamber;

a plurality of air supply lances entering said combustion chamber at said upper region and extending in the interior of said combustion chamber to said central region thereof for supplying additional primary combustion air to said central region;

a means for removal of said combustible gas from said combustion chamber communicating with said combustion chamber between said central and lower regions thereof;

a residue conveyor means for conveying residue of said carbonaceous material from said combustion chamber connected to said lower region of said combustion chanber; and a means for supplying secondary combustion air to said residue between said lower region of said combustion chamber and said residue conveyor means for additional gasification of said residue whereby supply of said primary and additional combustion air may be controlled for each of said sub-chambers for controlling combustion of said carbonaceous material therein.

2. The device of claim 1 further comprising an oscillating grate which forms a floor for said combustion chamber disposed between said lower region of said combustion chamber and said residue conveyor means.

3. The device of claim 1 wherein said residue conveyor means is a continuous scraper belt.

4. The device of claim 1 wherein said residue conveyor means is a chain conveyor.

* * * * *